United States Patent [19]

Brady et al.

[11] Patent Number: 4,682,987

[45] Date of Patent: Jul. 28, 1987

[54] METHOD AND COMPOSITION FOR PRODUCING HARD SURFACE CARBIDE INSERT TOOLS

[76] Inventors: William J. Brady, 1767 Wishingwell Dr., Creve Coeur, Mo. 63141; Harlan U. Anderson, 45 Johnson St., Rolla, Mo. 65401

[21] Appl. No.: 755,316

[22] Filed: Jul. 15, 1985

Related U.S. Application Data

[63] Continuation-in-part of Ser. No. 254,998, Apr. 16, 1981, abandoned.

[51] Int. Cl.[4] ..... B24D 3/00

[52] U.S. Cl. ..... 51/293; 51/295; 51/308; 51/309; 427/376.3

[58] Field of Search ..... 51/293, 295, 309, 307, 51/308; 427/376.3

[56] References Cited

U.S. PATENT DOCUMENTS

| | | | |
|---|---|---|---|
| 2,857,292 | 10/1958 | Moore | 427/376.3 |
| 3,372,010 | 3/1968 | Parsons | 51/309 |
| 3,600,201 | 8/1971 | Alessi | 427/376.3 |
| 3,615,309 | 10/1971 | Dawson | 51/309 |
| 3,751,283 | 8/1973 | Dawson | 51/295 |
| 4,155,721 | 5/1979 | Fletcher | 51/295 |
| 4,359,335 | 11/1982 | Garner | 51/309 |
| 4,534,773 | 8/1985 | Phaal et al. | 51/309 |

*Primary Examiner*—Paul Lieberman
*Assistant Examiner*—Willie J. Thompson
*Attorney, Agent, or Firm*—Richard G. Heywood

[57] ABSTRACT

A hard surfaced heavy duty cutting tool having an abrasive insert and method for hard surfacing and bonding metallic materials. The composition used in hard surfacing comprises a slurry coating including a high nickel, metal alloy powder and a fluxing agent. The slurry composition is fused at temperatures of about 1830°-1925° F. to bond an abrasive cutting element, such as tungsten carbide in a base metal matrix, to a cutting tool to form the primary working element thereof. The slurry composition is also fused at the same temperature range to form a wear surface of the tool adjacent to the abrasive insert as a hard surface, wear resistant coating in which abrasive compounds and other materials may be incorporated.

40 Claims, 5 Drawing Figures

METHOD AND COMPOSITION FOR PRODUCING HARD SURFACE CARBIDE INSERT TOOLS

This is a continuation-in-part application based upon U.S. parent application Ser. No. 254,998 filed Apr. 16, 1981 for Hard Surfaced Carbide Insert Tools and Method Therefor, now abandoned.

BACKGROUND OF THE INVENTION

This invention relates to heavy duty industrial, mining and general purpose cutting tools, and more particularly to cutting tools of the type having a bonded abrasive element forming the primary working element.

Decorative coatings for appearance, and wear resistant, hard surface coatings for protecting metal substrates against corrosion, thermal shock and the like are both well known in the prior art. The hard surfacing of a certain class of tools having a continuous cutting blade (such as agricultural implements, for instance) has been employed to form a primary, high hardness, working edge that is "self sharpening" during use in that wear of the hard surface material and tool blade continues to present a sharp primary working edge throughout. Such hard surfacing conventionally is accomplished by fusion in high temperature furnaces using high iron content, metal alloys, see Alessi U.S. Pat. No. 3,600,201. Other techniques for hard surfacing metal substrates to provide wear resistant, anti-corrosive metal coatings include flame or plasma spraying, detonation gun applications and the like as discussed in Patel U.S. Pat. No. 4,075,371 and Weatherly U.S. Pat. No. 4,173,685. Moore U.S. Pat. No. 2,857,292 teaches the application of high nickel content surface coatings to protect airplane engine parts and other ferrous alloys from corrosion, weathering and other deteriorating agents. The prior art is devoid, however, of any showing of the hard surfacing of heavy duty "cutting" tools employing abrasive inserts as the principal working element and in which the surface coating itself substantially enhances the working life of the tool by maintaining its integrity during normal wear of the abrasive insert workpiece. In the past a wide variety of industrial or general purpose cutting tools have been designed for numerous "cutting" functions including trenching, boring, drilling, sawing, and crushing. Typical cutting tools may use a single or continuous cutting surface or edge, but more frequently employ a plurality of discrete, replaceable cutting elements or bits either sequentially and angularly arranged on a chain, wheel, caisson or like continuous carrier or being disposed in a predetermined sequence or pattern on a rotary bit or auger of some type. A typical class of cutting tools, to which the present invention is particularly applicable, involves industrial mining equipment utilizing a series of sequentially spaced and angularly disposed "pencil" drill bits of the type disclosed herein, which have carbide or like abrasive inserts or tips to perform the primary cutting function.

In these mining tools the abrasive insert tip conventionally is brazed to the main body of the bit by silver solder to secure a solid bond that will withstand the large striking or impact forces thereon as the bit is carried into striking "cutting" engagement with the work product, such as coal, mineral ores or the like. The high cost, today, of silver solder has caused a search for acceptable, alternative brazing compounds. The industry now extensively uses bronze (or copper) brazing, but this requires substantially high brazing temperatures than silver and above the temperature at which temper (Rockwell hardness) of tool steels is lost, thereby influencing the choice of air or oil hardening processes for re-tempering the tool steel. Obviously, the tempering of tool steels has a direct bearing on metal stress, thermal shock and undetectable fracture lines so that a large number of abrasive inserts and/or bit bases are cracked or otherwise weakened in production with the end result of damage or loss of mining bits and increased production costs due to downtime and replacement expenses during mining operations.

Another problem encountered in such industrial mining equipment is that, with the advent of higher speed equipment and heavier impact forces, rapid tool wear and breakage has appreciably increased thereby causing re-design to heavier, bulkier bit configurations to support the carbide inserts and withstand these forces. However, more massive bits create higher dust levels that are more difficult to control under the stringent mining safety regulations, and non-productive downtime in operations frequently is mandated merely to bring dust levels under specified concentrations.

SUMMARY OF THE INVENTION

The present invention provides hard surfaced heavy duty cutting tool improvements as well as hard surfacing compositions for cutting tools having an abrasive insert of tungsten carbide or the like and for various other metallic surfaces including the bonding of abrasive insert elements on supporting tool surfaces. Through the slurry composition and method of this invention, the abrasive cutting element may be bonded to the tool base and a hard surface coating applied to the tool around the abrasive cutting element at relatively low temperatures of about 1830°–1925° F. The coating may be applied in slurry form, dried and then fused in conventional furnaces in open air, inert or reducing atmospheres.

The hard surface coating compositions of the present invention are comprised of a nickel-chromium metal alloy powder and a flux, usually boron and/or silicon, to provide low temperature fusing. The nickel-chromium metal alloy powder desirably contains lesser amounts of iron and has the general composition of 16–19 weight percent chromium (Cr), 3–6 percent iron (Fe), 0.5–2 percent carbon (C), 3–4 percent boron (B), 3–5 percent silicon (Si) and 45–75 percent nickel (Ni). The flux may be in the form of boric acid or borax or silicates added in an amount to provide about 2.5 to 20 weight percent based on the weight of the metal alloy powder employed. The coating composition is employed in the form of a slurry with the addition of a suitable liquid vehicle, such as water or alcohol, to provide a flowable fluid mix. For increased hardness a carbon containing organic vehicle may be employed such as glycerin, polyethylene glycol or ethylene glycol. The coating may be simply applied to the metal tool surface by brushing, dipping, spraying or the like. The coating when used as a bond for the abrasive cutting element employed in a cavity or socket of a cutting tool may be in somewhat more fluid form than when employed as a hard surface, wear resistant coating.

The slurry composition, when used as a hard surface coating for a wear surface of the tool adjacent the abrasive insert, may include a finely divided abrasive compound added to provide a supplemental work area that is more wear resistant. Such abrasive compounds may desirably employ one or more of various carbides, borides or alumina; for example, tungsten carbide, silicon carbide, aluminum oxide (i.e. alumina), molybdenum carbide, boron carbide, chromium carbide, vanadium carbide, zirconium carbide and titanium carbide.

The above features are objects of this invention. Further objects and advantages will appear in the detailed description which follows and will be otherwise apparent to those skilled in the art.

DESCRIPTION OF THE DRAWINGS

It is to be understood that the drawings are for purposes of example only and that the invention is applicable to other types of abrasive insert tool bits and heavy duty tools in general.

In the drawings which illustrate preferred embodiments of the invention, and wherein like numerals refer to like parts wherever they occur.

DESCRIPTION OF THE INVENTION

As used herein, the term "heavy duty cutting tools" shall mean all types of industrial, mining or general purpose tools subjected to heavy striking impact forces in performing the various "cutting" functions of trenching, boring, drilling, sawing, crushing, plowing and the like, and mining operations in coal, rock ore, or the like are given as a representative use for disclosure purposes and without limitation. Thus, for purposes of disclosure, articles, compositions and methods of the present invention are disclosed as being embodied in pencil-type mining tool bits 10A and 10B having abrasive inserts 12A and 12B bonded to the tool bit or body 14A and 14B, as illustrated in FIGS. 2–5.

It will be understood that the invention is generally applicable to all kinds of heavy cutting tools for industrial, mining and general purpose use, of the type that generally employ a plurality of discrete, replaceable cutting elements or bits sequentially and/or angularly arranged on a metal belt or chain, wheel, caisson or like continuous carrier or being arranged in some predetermined pattern on a rotary bit, auger, caisson or the like. In operation, such carrier member is moved at high speeds to sequentially drive the cutting elements or "teeth" into striking force with the work surface to perform trenching, boring, drilling, sawing, crushing or like "cutting" functions as in mining coal or like mineral deposits or quarrying rock, etc. as defined. Thus, the carbide insert, pencil-type, mining bits selected for disclosure purposes comprise only one form of such cutting bit or tool, and such bits are also typified by auger drill bits, roof drill bits, finger bits, percussion rock bits, rotary boring bits, conical bits, crusher bits and like heavy duty tool bits and blades well known in the industry.

Figure 4:
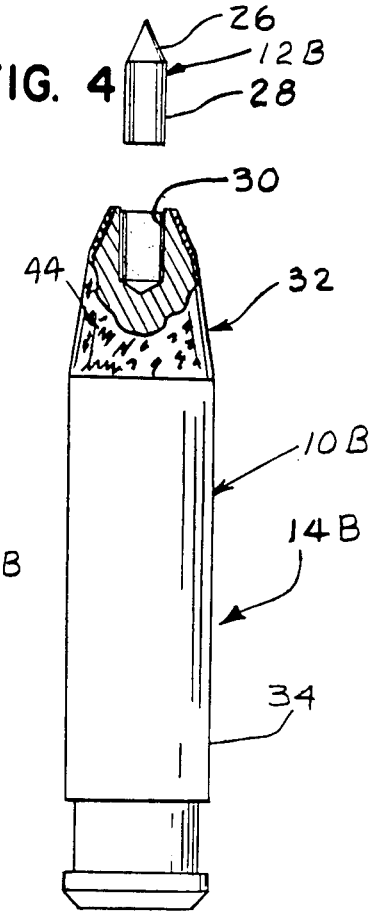
FIG. 4 is an exploded view, similar to FIG. 3 and partly in section, showing the coating and structural relationship of an abrasive cutting tip to the tool bit body.

Referring first to FIG. 4 showing the structural relationship of an abrasive cutting element or tip 12B to the tool body 14B in a typical pencil mining bit 10B, it will be apparent that the shank portion 28 of the insert is received axially in a cavity 30 bored in the nose end 32 of the bit body 14B. The abrasive insert conventionally is formed of tungsten carbide in a cobalt or base metal matrix, and a typical analysis of such insert is 89 percent tungsten carbide (WC) and 11 percent cobalt (Co). Such tungsten carbide cutting tips or inserts 12B are sintered at temperatures of 2300° F. and higher and have a typical hardness of 88 Rockwell C. The carbide insert 12B conventionally has been silver soldered (silver/copper alloy) into the socket 30 of the bit base 14B at brazing temperatures in the range of 1100°–1900° F. The tool body (14A,14B) of a typical mining bit (10A,10B) conventionally is formed of relatively high grade tool steel alloys of the type known in the trade as "AHT-28", "4140", "M2", "8630" or the like, which are tempered to hardness in the range of about 43–52 Rockwell C by conventional oil or aqua quenching or air hardening techniques. Other ferrous metal substrates for cutting tools embodying the present invention are considered to be included without specific identification or enumeration. Of particularly desirable use are air hardening steel alloys which will air harden after the relatively low temperatures of about 1830°–1925° F. employed in the present fusion process and which may be subsequently annealed as desired, but it will be understood that oil and aqua quench steels can now be used due to the temperature ranges used in the present method.

In the past, hard facing metal slurry compositions having high iron content have been used in wear coating other types of metal substrates including agricultural tools, as taught by Alessi U.S. Pat. No. 3,600,201, but such high iron slurry compositions in practice require high fusion temperatures above 2000° F. and generally in the range of 2100°–2250° F. and these temperatures cannot be satisfactorily employed in the hard surfacing of tool bits (10A,10B) having carbide insert elements (12A,12B) due to structural weakening of the base metal matrix of the insert as exemplified by stress cracking and embrittlement of the carbide insert and an excceedingly high incidence of damaged bits in manufacture and field use. The high fusion temperatures employed in such prior art processes further necessitated the utilization of the more expensive air hardening tool steels in the tool body as the less expensive oil hardening tool steels cannot satisfactorily withstand such high temperature processing. Another drawback of such high temperature processes has been the "boiling out" of lead in leaded steels. The present composition and process may be employed to wet and bond steel, whether leaded or not. It has now been determined, contrary to the teaching in the Alessi patent, that a high nickel alloy powder, which is low in iron can be fluxed with a boron or silicon compound to provide a hard surfacing composition fusable at a relatively low temperature with the desired hardness being controllable through the carbon content and other features. Furthermore, it has been found that this same basic high nickel, metal alloy slurry composition can be used in the fusing process to provide a novel bond (42 in FIG. 5) between the carbide insert 12A,12B and the cutting tool bit 10A,10B or the like without damage to the carbide insert thereby solving a serious problem in the industry.

The metal alloy powder used in the hard surfacing composition for coating the tool body or like metallic substrate is a high nickel, chromium alloy which may include smaller amounts of iron as well as silicon, carbon and boron. Parent application Ser. No. 254,998, now abandoned disclosed the range of constituents of the inventive hard surfacing, metal alloy composition as being 10–20 weight percent chromium, 0–10 percent iron, 60–90 percent nickel, 0–3 percent carbon, 0–6 percent boron and 0–6 percent silicon. However, in further research and testing it has been found that the constituent elements of the metal alloy composition useful in hard surfacing according to the invention have more limited range of 16–19 weight percent chromium, 3–6 percent iron, 45–75 percent nickel, 0.5–2 percent carbon, 3–4 percent boron and 3–5 percent silicon. As an example of a particular metal alloy powder, it has been found that a basic metal alloy may have a composition of 16.5 percent chromium, 4.5 percent iron, 70.6 percent nickel, 0.9 percent carbon, 3.25 percent boron and 4.25 percent silicon.

In order to achieve a low fusing temperature of the metal alloy powder in the range of 1830° to 1925° F. (1000°–1052° C.), a boron compound flux, such as boric acid or borax, or a silicon compound flux, such as sodium silicate, or combinations of boro-silicate or fluro-boro-silicate fluxes have been found necessary. The flux is employed in an amount of about 2.5 to 25 percent by weight of the metal alloy powder depending upon the factors of type of fusion furnace employed and the time duration required to bring the cutting tool mass up to fusion temperature. The amount of boron and/or silicon added by the flux may vary inversely with respect to the amounts of these constituents in the specific alloy composition in order to provide a total boro-silicate content (alloy and flux) in the range of 8.5 to 35 percent. The flux serves not only to facilitate a lower fusing temperature, which theoretically forms a eutectic mixture with the metal components of the alloy, but also serves to provide borides with the metal forming components which contribute to the wear and hardness properties of the fused hard surface coating provided by this invention and, in addition, dissolves the oxides present in the metal substrate to provide improved wettability. Thus, it should be noted that the flux further serves in the fusion process to form boro-silicate glass-like or ceramic slags which are formed on the surface. The flux, which melts before the fusion temperature of the metal alloy powder is reached in the formation of such slag, protects against oxidation and acts as a scavenger. The slag, during complete fusion of the coating, migrates to the surface as a scale which is easily removed from the metal alloy coating. An argillaceous compound, such as diatomaceous earth, bentonite, kaolin, montmorillonite and other clays, may also be used in the coating to further promote such slag formation and scavenging action, although the primary function of such argillaceous materials is to act as a binder in application coating, as will appear.

Figure 1:
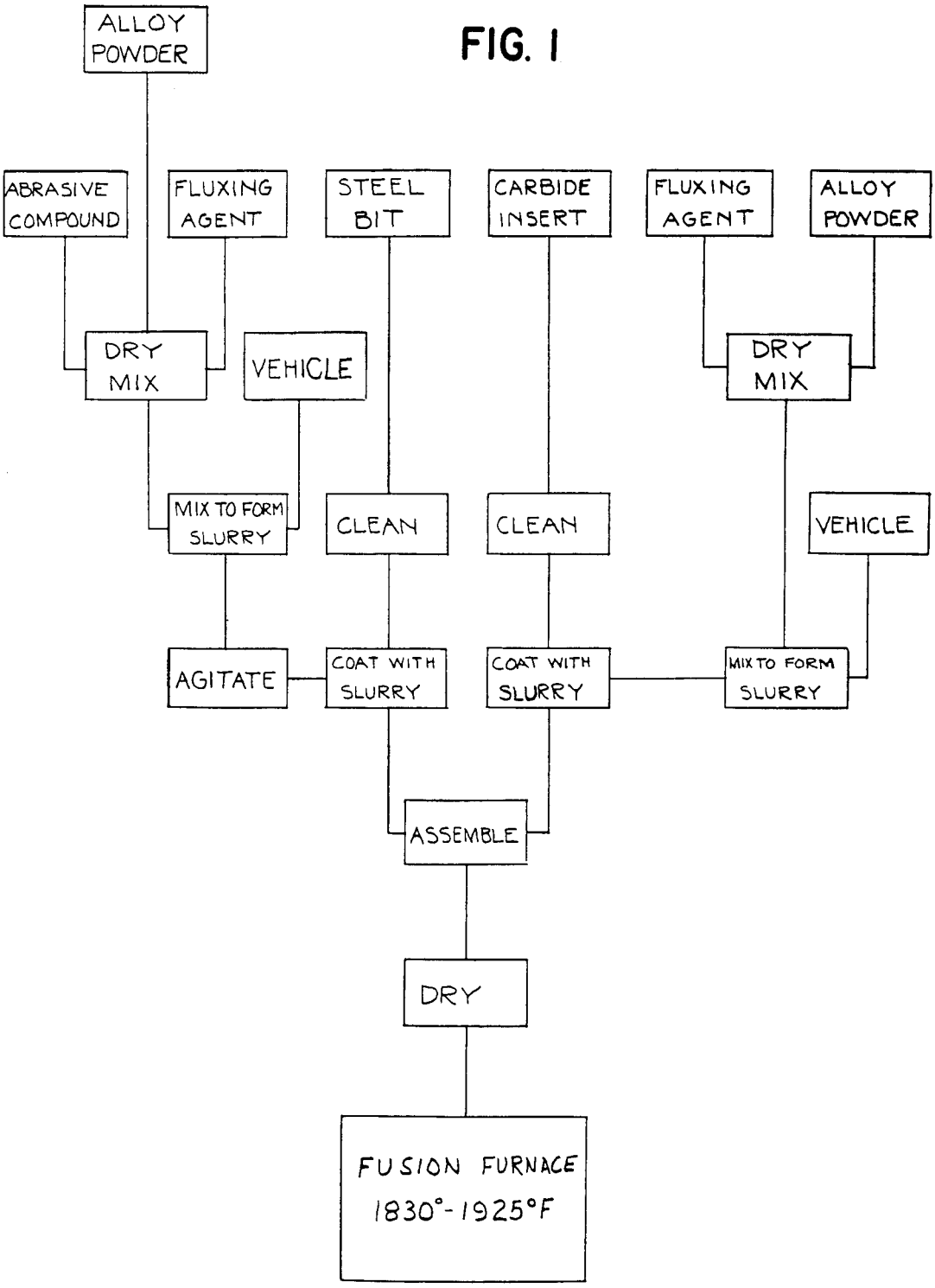
FIG. 1 is a flow sheet showing a preferred method for hard surfacing heavy duty carbide insert tools according to the present invention.
Figure 2:
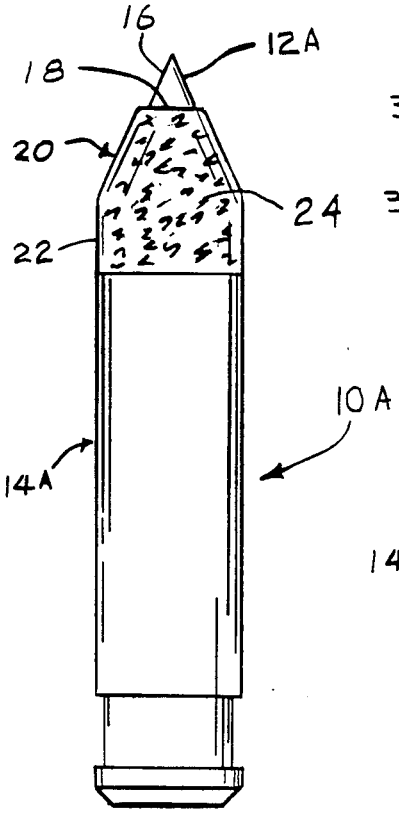
FIG. 2 is an elevational view of a typical pencil-type mining tool bit provided with a hard surface coating embodying this invention.
Figure 3:
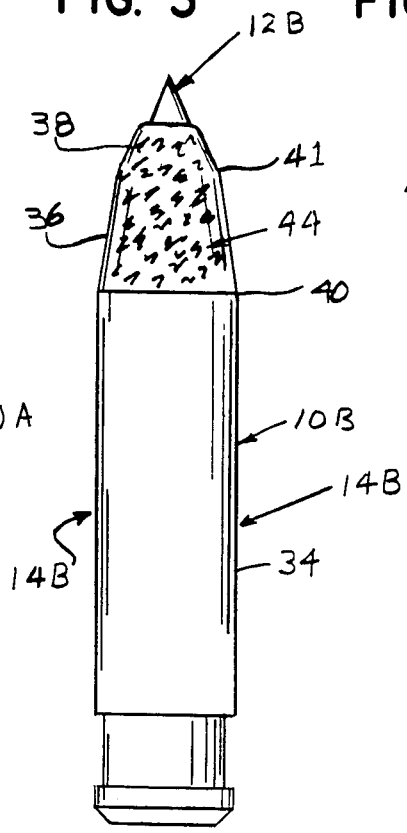
FIG. 3 is an elevational view of a modified tool bit provided with a hard surface coating.

The preparation of the metal alloy slurry composition of this invention and its application to a mining tool bit of the type shown in FIGS. 2, 3 and 4 is illustrated in the flow sheet of FIG. 1, as will be described more fully hereinbelow.

Referring now to FIG. 2, a typical mining tool bit of tool steel having a hardness of about 43 Rockwell C is generally indicated by the reference numeral 10A and is of the type employed in mining machines for mining coal, iron, trona and other minerals. Some 150 to 250 of these bits 10A may be used in each mining machine drilling head and are removably laced in the machine in desired patterns as will be well understood in the art. These bits are subject to extensive wear in normal mining or like cutting operations and necessitate considerable downtime of machinery when replacement is necessitated. The mining tool bit 10A has an abrasive cutting element 12A of tungsten carbide in a cobalt matrix with a hardness of about 80–90 Rockwell C. The element 12A has a conical end configuration or cutting tip 16 which extends beyond the shoulder 18 of a tapered nose portion 20 of the tool bit body 14A and performs the primary working or cutting function of the tool bit 10A. The carbide insert 12A is bonded within the nose 20 of the tool body 14A around a shank of the carbide tip received in a cavity or socket provided in the nose portion 20, as previously described with particular reference to FIG. 4. The carbide insert 12A has a close tolerance fit within the nose cavity, and may be securely bonded therein by using the high nickel composition of the present invention which flows throughout the interface between the insert 10A and the support surface 30. The nose portion 20 of the tool bit 10A is tapered to minimize the forces exerted during the cutting operations while forming a solid support base for the primary carbide cutting tip 12A. Thus, the nose portion 20 forms a wear surface extending away from the cutting tip 16, and this wear surface of the tool body 14A and the body portion 22 adjacent thereto is coated with the high nickel alloy composition 24 of the present invention to substantially increase the wear life of the tool body 14A and maintain the integrity of the carbide insert 12A.

Referring now to FIGS. 3 and 4, a modified pencil-type mining tool bit 10B is also typical of cutting tools that may embody the hard surfacing composition of this invention. The bit 10B likewise employs a carbide element 12B having an abrasive conical cutting tip 26 and a base or shank 28 receivable within the cavity or socket 30 in the nose portion 32 of the tool body 14B, as previously described. The nose portion 32 of the tool body 14B is formed of two inclined frusto-conical surfaces 36 and 38 with the former being connected to the main cylindrical wall 34 of the tool body 14B at shoulder 40 and the surfaces 36 and 38 being joined at shoulder 41. These relatively inclined surfaces present a sharper nose section 32 as compared to the heavy nose portion 20 and shoulder 18 of the tool bit 10A to reduce the wear on the bit and provide a sharper cutting action with very substantial reduction of dust and fines encountered in the cutting operation.

The structure of the tool bit 14B has been made possible by the use of the hard surfacing composition of this invention which effectively protects the nose portion 32 and the bond 42 between the shank 28 of the carbide element 12B and cavity wall 30 in the nose portion 32 of the tool bit 10B. Stated another way, the more efficient and low dust producing tool bit configuration of FIGS. 3 and 4 has not been entirely satisfactory heretofore due to a high incidence of breakage resulting from high production speeds and the industry trend has been to the more massive tool configuration of FIG. 2 in order to minimize such breakage, downtime and replacement cost even though dust control problems are substantially greater. However, carbide insert cutting tool bits 12B of the present invention, i.e. incorporating the metal alloy composition in bonding (42) the carbide insert 12B to the tool body 14B and providing a hard surface coating (44) on the nose portion 32, have a substantially longer wear life than the more massive, but conventional tool bit configuration of FIG. 2 (when not processed according to this invention).

Figure 5:
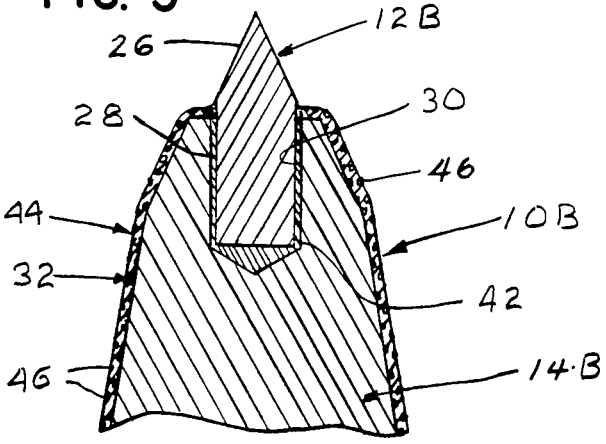
FIG. 5 is an enlarged, fragmentary, sectional view of a tool bit embodying the present invention.

As best shown in FIG. 5, the hard surface coating of this invention is generally indicated by the reference numeral 44. This coating may have incorporated in it one or more abrasive materials or compounds 46, such as the various carbides, borides or alumina disclosed herein, to increase the wear life of the cutting tool and the coating itself. The use of the same metal alloy composition (without such abrasive materials) to bond the carbide tip in the nose cavity of the tool bit results in a strong bond and eliminates the necessity for more expensive silver solder or the like bonding materials. Further, the carbide element 12B is not stress weakened by using the method of this invention.

The method of this invention for preparing slurry compositions for insert bonding and hard surfacing coating and the application thereof to a carbide insert tool bit formed of an air hardening tool steel is shown in diagrammatic form in the flow sheet of FIG. 1. The slurry coating is prepared in a first stage by dry mixing the nickel-chromium metal alloy powder with the fluxing agent in an amount up to about 25 percent boron/-silicon flux based on the weight of the metal alloy. The metal alloy powder is employed in finely divided form, e.g. of a size in the range of about −325 mesh to about −270 mesh, although it has been determined that the mesh size is not critical and can be in the range of −60 to −325. The dry mix of alloy powder and fluxing agent may be stored, packaged or shipped as desired. Ultimately, it is prepared for use by mixing with an appropriate liquid vehicle. The liquid vehicle, preferably in the form of water or alcohol, is added in an amount of about 2–15% by weight to provide the desired flowable slurry consistency for application to the surfaces of the tool bit (10A,10B) and/or the carbide insert (12A,12B).

As discussed, the same basic metal alloy powder and fluxing agent composition may be used to bond (42) the carbide insert 12A,12B to the tool body 14A,14B as is used to form the hard surface coating 44 on the nose portion 20,32 of the cutting tool 10A,10B. The hard surface coating slurry to be applied to the nose portion 32 should be more viscous than the slurry used to bond the carbide insert within the cavity 30 of the tool bit, and the dry mix preparation for the exterior surface coating slurry may also include one or more abrasive compounds (46) to provide additional wear and hardness properties as well as a binder and porosity reducing function to the coating. Such abrasive compounds may comprise tungsten carbide, silicon carbide, aluminum oxide, molybdenum carbide, molybdenum boride, boron carbide, chromium carbide, vanadium carbide, zirconium carbide and titanium carbide added in amounts of 5–34 percent by weight percent relative to the weight percent of the dry mix of metal alloy powder and fluxing agent. The abrasive compounds employed in the hard surface coating are generally of a size of about −325 mesh, although the mesh size is noncritical and may be in the range of −60 to −325 and these compounds also have a wide range of density which is a factor in providing different concentrations in the fused coating. Thus, the metal alloy powder may have a density of about 8.9 to 9.2 in grams per cubic centimeter, and typical densities of the abrasive compounds include silicon carbide at 3.2, titanium carbide at 4.93, molybdenum carbide at 9.2, molybdenum boride at 8.77, aluminum oxide at 3.97, chromium carbide at 6.68, vanadium carbide at 5.77, zirconium carbide at 6.73 and tungsten carbide at 15.7. Thus, as will appear from the examples, the amount of silicon carbide used is in the range of 5–15 percent whereas up to 34 percent tungsten carbide may be employed.

As also discussed elsewhere, argillaceous compounds such as diatomaceous earth, bentonite, kaolin, montmorillonite and other clays are useful in the surface coating slurry as a binder during liquification as fusion temperatures are approached. Such argillaceous materials, added in the surface coating slurry or dry mix therefor in the range of 2–4 percent by weight of the dry mix, act with the fluxing agent in the formation of boro-silicate surface glass to obviate oxidation, and thus may enable the fusion process to be carried out in conventional open air furnaces.

The metal surfaces upon which the slurry coatings are to be supplied are first properly prepared. The tool bit body 14A,14B is cleaned, as by blasting, ultrasonic cleaner or other conventional methods, and the carbide element 12A,12B is also thoroughly cleaned. The bonding coating (42) is effected by applying the metal alloy slurry by brushing (painting), dipping, spraying or the like to the cavity 30 and/or the base 28 of the carbide member, which are then assembled. As previously mentioned, the slurry employed in such bond coating may be thinner than the hard surface coating employed on the exterior of the nose portion 20,32, which will occasion the preparation of two different slurry mixtures. The relative thickness or viscosity of these slurries may be controlled by varying the amount of liquid vehicle, or the exterior hard surface coating mixture may be thickened by the addition of the abrasive compounds and/or the argillaceous materials. The hard surface coating slurry is also applied by brushing, spraying or dipping, and this exterior coating can be carried out either before or after the carbide element 12A,12B is assembled by inserting the shank 28 into the cavity 30 at the nose of the bit. Such surface coating 44 may have an optimum thickness of about $\frac{1}{8}$ inch, but single application step coatings are easily made up to $\frac{3}{8}$ inch and even thicker coatings may be applied by a double fusion process.

The assembled tool bit (10A,10B) is then dried before introduction to the fusing stage. The drying stage may be carried out at room temperature over a period of time up to 24 hours or in an oven at low temperatures up to 200° F. for shorter periods of time, e.g. fifteen minutes. In this manner rupture of the coating by eruption of free water in the relatively higher temperature fusion stage is avoided.

The dried tool bit is then subjected to the fusion stage, which is carried out at 1830°–1925° F. in various types of furnaces in an inert or reducing atmosphere containing less than 0.1 percent oxygen or, with the inclusion of glass forming constituents in the coating 44, in an open atmosphere furnace. The period of time necessary to carry out the fusion will vary with the type of furnace employed which may vary from about 2 seconds to 3 minutes in an induction furnace to as much as 24 hours for a box furnace where longer periods of time may be required to heat the large body mass of certain cutting tools. Pencil tool bits of the type disclosed require 2-5 seconds in an open air induction furnace where zone heating of the tool bit tip area being coated can be effected. Thus, the heating period in the fusion stage must be carried out for a sufficient period of time to ensure that the entire cutting tool body mass (14A,14B) in the coating area is brought up to the optimum fusion temperature for the coating. When fusion occurs, the coating changes from a grainy appearing texture to a fluid metallic-appearing coating which may have a tendency to run off the exterior tool surface. It is at this point that the function of the added abrasive compound and/or argillaceous material, as a binder to thicken the fused coating and prevent such running, is of great importance. Finely divided tungsten carbide, of −325 mesh for example, has been found to serve very well.

In the fusing process the carbide insert (12A,12B) is bonded within the cavity of the nose portion of the tool bit. In this bonding process, the fluidity of the fused coating does not present a problem but rather serves to ensure that a complete wetting of the interface between the complementary mating surfaces of the insert and the tool bit is effected to provide a completely fused bond.

Upon the completion of the fusing stage the bit is cooled. In the cooling stage, the air hardening tool steel may be annealed in air at 500° F. for 1 to 24 hours as in conventional practice. The relatively low temperature of 1830°-1925° F. employed in the fusing stage makes possible the use of conventional air hardened tool steels and greatly facilitates the manufacturing process and reduces expense with sure results, and after the air cooling process the tool bit is then ready for use. It will be understood that oil and aqua quench steels may also be employed in the present process, and high quality hard surface coatings can be produced at high Rockwell C hardness by rapid quenching immediately after achieving fusion temperature, as will be described more fully.

For the purpose of further illustration of the composition and method of the invention, the following examples thereof are provided. In these examples various coating compositions and furnaces of various types are disclosed and the fusing of the coating is carried out in the general temperature range of about 1830° F. to 1925° F.

EXAMPLE 1

A slurry composed of 10 cc water, and 100 gms of −270 mesh of a basic metal alloy composition having 16½ w % Cr, 4½ w % Fe, 70.6 w % Ni, 0.9 w % C, 3.25 w % B, 4.25 w % Si, together with 23 gms boric acid is formed. This slurry is applied to a pencil-type conical mining bit covering the tapered surface and cavity after which the carbide element is inserted as described in FIG. 1. The slurry coating tool is dried and placed in an induction coil in either a nitrogen, argon, or reducing atmosphere. The bit is heated to about 1875° F. and held at maximum temperature for up to one minute. The bit is then allowed to cool, then is stress relieved at 700° F. for 1 hour and is ready for use on a mining machine.

EXAMPLE 2

A slurry is made and applied to a conical pencil bit in the manner described in Example 1. The assembled bit is dried and placed in a box furnace and electrically heated to about 1900° F. in either nitrogen, argon, or reducing atmosphere. The duration of time at 1900° F. is 15 minutes with the total time in the furnace of 60 minutes. Tests show that bits made in this manner have two to three times more wear than the bits currently used.

EXAMPLE 3

100 gms of −270 mesh alloy of composition 16½ w % Cr, 4½ w % Fe, 70.6 w % Ni, 0.9 w % C, 3125 w % B and 4.25 w5 Si is mixed with 23 gms of −325 mesh WC and 17 gms boric acid, and sufficient water to make a paintable slurry. This slurry is applied to a pencil-type conical bit in the manner described in Example 1. The assembled bit is dried and heated in a box furnace to 1900° F. in an argon atmosphere. The duration of time at 1900° F. was 5 minutes with the total time in the furnace being 30 minutes. Bits made in this manner were tested and showed three to four times longer life than conventional bits.

EXAMPLE 4

Same as Example 3 except 10 gms of −325 mesh SiC is used.

EXAMPLE 5

Same as Example 3 except 10 gms of −325 mesh aluminum oxide is used.

EXAMPLE 6

Same as Example 3 except a mixture of SiC,$Mo_2C$ or MoB and WC, instead of only WC, is added. The reason for this mixture is to provide a more homogeneous distribution of the carbide in the coating. The SiC tends to segregate on the surface, the $Mo_2C$ tends to be distributed throughout, while the WC segregates to the metal-coating interface. This allows a more homogeneous wear pattern in the coating.

EXAMPLE 7

Same as Example 6 except either $B_4C$, $Cr_3C_2$, VC, ZrC, or TiC replaces SiC.

EXAMPLE 8

Same as Example 6 except $Al_2O_3$ replaces SiC.

In the practice of this invention it has been found that the hardness of the surface coating (44) of the tool bit (12B) may be controlled to a desired degree in a number of different ways. Such hardness can be desirably controlled by ensuring a proper carbon content. In general, hardness increases as the amount of carbon is increased. The proper carbon content can be effected by regulating the carbon content in the metal alloy powder, by adding carbon in the form of various carbon compounds in the slurry coating composition and by employing a carbon-containing atmosphere in the fusion process. The hardness may also be controlled by employing the proper temperature in the fusion process which for increased hardness generally requires a higher temperature.

In general, for tool steel having a Rockwell C hardness of 43 with a carbide tip of about 88 Rockwell C, the hardness of the coating should be in the range of about 45 to 62 Rockwell C. While higher hardness may be attained, care must be employed at the higher hardness range to ensure that embrittlement and cracking is not present due to the nature of use of such heavy duty cutting tools in the field.

In order to illustrate the manner of control of hardness, the following examples are given in which fusing of a slurry coating on a tool steel substrate was carried out in an argon atmosphere of 1920° F.

EXAMPLE 9

The metal alloy powder employed in Examples 1–8 was fused upon the tool steel substrate without added flux. The Rockwell C hardness was determined to be 44.

EXAMPLE 10

The same basic metal alloy powder as previously set out in Examples 1 and 3 was mixed with 19 weight percent (w %) of $H_3BO_3$ based on the weight of the alloy to provide a content of 4% B. Water was added to form a slurry coating and applied and fused to the tool steel substrate. The Rockwell C hardness was determined to be 45.

EXAMPLE 11

The same aqueous slurry as in Example 10 had added to it 2 weight percent of finely divided bentonite clay. After fusing on the tool steel substrate, the Rockwell C hardness of the coating was determined to be 46 demonstrating that the bentonite clay, which was added as a suspension agent or binder to aid in a dipping application, had no deleterious effect on the hardness.

EXAMPLE 12

The same slurry and added bentonite clay as in Example 11 was fused in an open atmosphere, and the coating was determined to have a Rockwell C hardness of 50.

EXAMPLE 13

The dry mix of Example 10 without added water was mixed with polyethylene glycol and applied to the tool steel substrate and fused. The increased carbon content achieved by the addition of the polyethylene glycol resulted in an increased Rockwell C hardness of 52.

EXAMPLE 14

A similar dry mix to that of Example 10 was mixed with ethylene glycol and applied to the tool steel substrate and fused. The Rockwell C hardness was determined to be 48 demonstrating a similar increase in hardness through the addition of the carbon content in the ethylene glycol.

EXAMPLE 15

The same slurry and process as set forth in Example 10 was employed with 25% by volume of WC based on the volume of the metal alloy powder. The Rockwell C hardness was 52.

EXAMPLE 16

The slurry and process of Example 10 was employed with 16% SiC. The Rockwell C hardness was 47.

EXAMPLE 17

The slurry and process of Example 10 was employed with 5% $Al_2O_3$, 5% MoB and 6.5% WC by volume. The Rockwell C hardness was 48.

EXAMPLE 18

The slurry and process of Example 10 was employed with 5% SiC, 5% MoB and 6.5% WC. The Rockwell C hardness was 49.

EXAMPLE 19

The slurry and process of Example 10 was employed with 5% $Al_2O_3$, 5% $Mo_2C$ and 6.5% WC. The Rockwell C hardness was 45.

EXAMPLE 20

The slurry of Example 10 was modified to contain 4% by weight bentonite based on the weight of the metal alloy powder and 25% WC. Instead of fusing in an argon atmosphere, the fusing was carried out in an induction furnace which was open to ambient air. In the fusing stage, the fused coating was covered on the exterior surface with a glassy slag-like composition which formed a protective coating against oxidation. The glass-like or ceramic coating easily breaks and can be cleaned off to leave the hard surfaced coating on the steel substrate and a Rockwell C hardness of about 50 was produced. By the use of the bentonite in the present example, the necessity of employment of a special atmosphere to protect against oxidation has been avoided permitting the process to be carried out in an open atmosphere with standard induction furnace equipment.

The hardness may also be increased by applying a reducing flame to the hard surface coating of this invention when applied to a steel substrate such as a tool bit or the like. Thus, the application of an acetylene flame as in an acetylene torch has been found to increase the Rockwell C hardness to 50 and above and as high as 64. Carbon containing atmosphere in the fusion furnaces may also be employed such as "forming gas" comprised of CO, $NH_3$ and $CH_4$.

Subsequent to applicant's parent application Ser. No. 254,998, extensive testing of heavy duty cutting tools and further experimental development has resulted in a better understanding of hard surface coatings and produced uniformity and high quality cutting tools. The following additional examples show compositions having superior wear characteristics:

EXAMPLE 21

A slurry composed of 10 cc water, and 100 gms of −270 mesh of a modified basic metal alloy composition (similar to Example 1) having 16.33 w % Cr, 4.52 w % Fe, 70.76 w % Ni, 0.99 w % C, 3.2 w % B, 4.2 w % Si to which is added 0.4 w % Co and 0.055 Mo. 10 gms of a boron/silicon fluxing agent and about 34 w % of WC is added. This slurry is applied to a cutting tool, dried and heated in an open atmosphere induction furnace to a temperature of 1875°–1925° F. and, when cooled, produces a hard surface coating with a hardness of 55–59 Rockwell C.

EXAMPLE 22

A slurry of 10 cc water and the 100 gm of the basic metal alloy composition of Example 21 inclusive of the cobalt (Co) and molybdenum (Mo) is made with a nickel content reduced to about 68.76, to which is added about 2.0 w % of vanadium (V) thereby providing a dense composition structure with a nearly zero porosity. 10 gm of fluxing agent and 34 w % of WC is added to complete the slurry and, when dried and fused as a hard surface coating on a tool body at a temperature of 1825°–1925° F., has a hardness of about 55–59 Rockwell C.

EXAMPLE 23

A slurry of 10 cc water and 100 gm of basic metal alloy composition of Example 21 inclusive of the Co and Mo content, but with the Ni reduced to 70.66 is made up, and 0.1 w % of manganese (Mn) is added together with 10 gm of a boron/silicon fluxing agent and 34 w % of WC as before. This slurry produces a hard surface coating when fused in the range of 55–59 Rockwell C hardness.

EXAMPLE 24

An experimental slurry was made using 10 cc water and 100 gm of a −270 mesh metal alloy composition having 18.5 w % Cr, 2.0 w % Fe, 27.0 w % Ni, 0.1 w % C, 3.2 w % B, 3.3 w % Si, 5.5 w % Mo and 40.4 w % Co, which was mixed with 10 gm of boron/silicon flux and 34 w % WC. This composition was not satisfactory and required fusion temperatures of and about 34 w % of WC is added. This slurry is applied to a cutting tool, dried and heated in an open atmosphere induction furnace to a temperature of 1875°–1925° F. and, when cooled, produces a hard surface coating with a hardness of 55–59 Rockwell C.

EXAMPLE 22

A slurry of 10 cc water and the 100 gm of the basic metal alloy composition of Example 21 inclusive of the cobalt (Co) and Molybdenum (Mo) is made with a nickel content reduced to about 68.76, to which is added about 2.0 w % of Vanadium (V) thereby providing a dense composition structure with a nearly zero porosity. 10 gm of fluxing agent and 35 w % of WC is added to complete the slurry and, when dried and fused as a hard surface coating on a tool body at a temperature of 1825°–1925° F., has a hardness of about 55–59 Rockwell C.

EXAMPLE 23

A slurry of 10 cc water and 100 gm of basic metal alloy composition of Example 21 inclusive of the Co and Mo content, but with the Ni reduced to 70.66 is made up, and 0.1 w % of Manganese (Mn) is added together with 10 gm of a boron/silicon fluxing agent and 34 w % of WC as before. This slurry produces a hard surface coating when fused in the range of 55–59 Rockwell C hardness.

EXAMPLE 24

An experimental slurry was made using 10 cc water and 100 gm of a 270 mesh metal alloy composition having 18.5 w % Cr, 2.0 w % Fe, 27.0 w % ni, 0.1 w % C, 3.2 w % B, 3.3 w % Si, 5.5 w % Mo and 40.4 w % Co, which was mixed with 10 gm of boron/silicon flux and 34 w % WC. This composition was not satisfactory and required fusion temperatures of 2050° F. outside the scope of the inventive method range and the resulting coating was brittle, did not bond well to the carbide insert and showed stress corrosion, and cracking occurred upon quenching.

EXAMPLE 24A

The secondary composition of Example 24 was combined in a ratio of 75% (gms) to 25% (gms) of the basic metal alloy composition of Example 21 in an aqueous slurry having 10 gms fluxing agent and 34 w % tungsten carbide particles, and the resultant hard surface coating was brittle and unacceptable. It has been discovered that the carbide particle loading tends to increase brittleness as does cobalt, but the cobalt is valuable in increasing or controlling the Rockwell hardness. Thus, the upper limit of cobalt in a hard surfacing composition should be limited to the range of 20–25%, and the following Examples 25–28 are representative of compound metal alloy compositions combining the secondary composition of Example 24 with the basic composition of Example 21 to produce excellent hard surfacing wear characteristics.

EXAMPLE 25

An aqueous slurry was made up using 10 cc water and a compound metal alloy composition of the Example 21 basic alloy and the Example 24 secondary alloy, as follows: 50 gms of metal alloy composed of 16.33 w % Cr, 4.52 w % Fe, 70.76 w % Ni, 0.99 w % C, 3.2 w % B and 4.2 w % Si plus 0.4 w % Co and 0.55 w % Mo (Example 21) was combined with 50 gms of metal alloy composed of 18.5 w % Cr, 2.0 w % Fe, 27.0 w % Ni, 0.1 w % C, 3.2 w % B, 3.3 w % Si, 5.5 w % Mo and 40.4 w % Co (Example 24) to form the compound alloy composition. To this was added 10 gms of sodium silicate as a fluxing agent and 34 w % tungsten carbide particles, and the slurry was coated on a heavy duty cutting tool, and dried, then fused at a temperature of about 1830°–1925° F. to a hardness of about 53–58 Rockwell C and produced an excellent, uniform hard coating.

EXAMPLE 26

An aqueous slurry with 80% of the Example 21 metal alloy composition was combined with 20% of the Example 24 metal alloy composition as was made in the 50-50% formulation of Example 25, together with the fluxing agent and tungsten carbide particles, to produce similar high quality coating results in the same hardness range.

EXAMPLE 27

An aqueous slurry with 90% of the Example 21 metal alloy composition and 10% of the Example 24 metal alloy composition, together with 10% fluxing agent and 34% tungsten carbide aggregate, produced similar high quality coating results in the same hardness range.

EXAMPLE 28

An aqueous slurry with 99% of the Example 21 metal alloy composition and 1% of the Example 24 metal alloy composition, together with the fluxing agent and tungsten carbide particles, produced a high quality hard surface coating in the hardness range of 53–58 Rockwell C.

EXAMPLE 29

Same as Example 21 except 5–15% SiC replaces WC; 5–15% SiC is a maximum range due to the relative density of this compound.

EXAMPLE 30

Same as Example 29 except either $B_4C$, $CrC_2$, VC, ZrC, TiC, BN, any of the four sialons, AlTiC or $Al_2O_5$ or combinations thereof replaces SiC. $Al_2O_5$ does not have a good appearance and is slightly brittle, but showed good wear characteristics and can be used advantageously with most carbides to reduce costs.

EXAMPLE 31

An aqueous slurry using a metal alloy composition similar to Example 23 includes 16.3 w % Cr, 4.52 w % Fe, 70.13 w % Ni, 0.99 w % C, 3.2 w % B, 4.2 w % Si, 0.4 w % Co and 0.055 Mo and also includes 0.2 w % of either $BaCO_3$, $NaCO_3$, $CaCO_3$, $Na_2O$, CaO or BaO, to which is added 2.5%-23% fluxing agent and 34 w % WC. $BaCO_3$, $NaCO_3$, $CaCO_3$, $Na_2O$, CaO and BaO are interchangeable and act as catalysts to promote carbide forming and produce a very hard, dense coating.

In the development and testing program of which the foregoing Examples 21-31 are representative, the parameters of several important factors pertaining to the inventive composition and method of hard surface coating have been determined. As stated elsewhere, the mesh size of the constituents in the metal alloy composition is not critical and are in the range of −60 to −325 and, similarly, the tungsten and other carbide abrasive particles added to this composition also permit a wide range of mesh size from −60 to −325. However, the relative density of the different carbides is important in determining the amounts that can be added and up to 34 weight percent of tungsten carbide can be used whereas only 5-15 weight percent of silicon carbide is acceptable and, in combining different carbides as disclosed, the ratios based upon relative density will vary inversely by the same weight percent. Tungsten and molybdenum can be used in the metal alloy either alone or in combination up to 5.5 to 6 percent.

The optimum percentage of glass-forming flux for the composition should be about 10 percent and in the overall range of 2.5% to 25%, although oxidation and poor ceramic quality may occur below 5% flux content in more massive cutting tool bodies that require longer heating times to produce fusion temperatures. A larger amount of flux is required for longer duration of heating. It has been determined that excellent ceramic quality and hard surface coatings are produced by using a fluoro-boro-silicate flux having 10-15 parts boric acid or borax, 10-20 parts of sodium silicate and 5 parts consisting of CaF, NaF and BaF in a ratio of 16-25% CaF, 4-15% NaF and 60-40% BaF with a gum arabic binder of 5-15%. The fluoride enhances oxidation reduction and assists in tool surface cleaning for bonding. Chloride compound equivalents of the fluorides can be substituted, but are not preferred for health reasons. It should also be understood that the use of too much fluxing agent is unacceptable since, as the flux flows to the surface and forms a hard ceramic silicate-glass (or fluoro-boro-silicate) surface layer protecting the metal coating composition from oxidation, voids or uneven layering may occur in the metal alloy composition coating.

In the bonding of carbide inserts 12A,12B to a tool body 10A,10B a compatible alternative brazing compound, in lieu of using a slurry of the metal alloy composition, comprises a composition formed with 81% copper, 4% cobalt, 14% manganese and about 1% chromium.

The more elegant metal alloy compositions of Examples 21-31 including portions of cobalt, molybdenum, vanadium, manganese and the like enable higher Rockwell C hardness to be achieved in the range of 53-68, although with higher density ceramic-forming fluxing the hard surface coating tends to become slightly brittle at 64-68 Rockwell C and a hardness in the range of 58-62 Rockwell C is considered best, at least for utility and mining applications of heavy duty cutting tool. This Rockwell hardness is best controlled by a rapid quench process upon achieving fusion temperature in using oil and aqua quench tool steels, and the tools are ready for immediate use.

There has been provided by this invention hard surfaced carbide insert cutting tools and like heavy duty tools, and a method and compositions for bonding abrasive inserts to tools of various types and hard surfacing the wear surface of such tools adjacent the carbide insert. In the process the basic slurry composition may be employed for bonding the insert as employed in the hard surfacing application which greatly simplifies the manufacturing and application process.

The relatively low temperatures employed in the fusing process achieved through high nickel alloy and boro-silicate flux ensures that the bonding and hard surfacing applications are carried out without damage to the carbide insert. The resultant tool with the bonded carbide insert and hard surfaced wear coating is strong and durable and has a greatly increased life in the field.

The metal alloy slurry composition may have added to it desirable abrasive components such as various carbides and borides and ceramics such as alumina to enhance the abrasive action of the coating. The aforementioned features may be obtained with control of the hardness of the coating as desired by proper manipulation of the carbon content and temperature control and tempering.

The method of hard surfacing the tool and bonding the insert can be carried out with relatively simple formulation and fusing under relatively low temperature fusing conditions in standard open air or inert atmosphere furnaces. These features all contribute to an economical and efficient manner for making heavy duty cutting tools of greatly improved value to the mining, construction and allied industries.

Various changes and modifications may be made in this invention as will be readily apparent to those skilled in the art. Such changes and modifications are within the scope and teaching of this invention as defined by the claims appended hereto.

What is claimed is:

1. A heavy duty cutting tool of the type subjected to large impact forces in performing such cutting functions as trenching, boring, drilling, sawing, plowing, crushing and the like as in industrial mining and like operations, said cutting tool including a tempered steel body and having primary cutting means thereon and a wear surface extending away from said primary cutting means, and a hard surface coating applied to said primary cutting means and said wear surface, said hard surface coating comprising a metal alloy composition having a high nickel content in the range of 45-75 weight percent and a substantial amount in the range of 5-25 weight percent of a glass-forming fluxing agent, and said coating being fused to said tool body at a temperature in the range of 1830°-1925° F. with a resultant hardness in the range of 55-68 Rockwell C.

2. The cutting tool according to claim 1, in which said metal alloy composition also comprises 16-19 weight percent of chromium, 3-6 percent of iron, 0.5-2 percent carbon, 3-4 percent boron and 3-5 percent silicon.

3. The cutting tool according to claim 1, in which said fluxing agent is selected from a group consisting of boron compounds, silicon compounds, boro-silicates and fluoro-boro-silicates.

4. The cutting tool according to claim 1, in which said metal alloy composition also includes up to about 34 percent by volume of an abrasive material selected from a group consisting of tungsten carbide, silicon carbide, aluminum oxide, molybdenum carbide, molybdenum boride, boron carbide, chromium carbide, vanadium carbide, zirconium carbide and titanium carbide.

5. The cutting tool according to claim 1, in which said metal alloy composition includes about 2–4 weight percent of an argillaceous material selected from a group consisting of bentonite, kaolin, montmorillonite, clay and diatomaceous earth.

6. A heavy duty cutting tool of the type subjected to large impact forces in performing such cutting functions as trenching, boring, drilling, sawing, plowing, crushing and the like as in industrial mining and like operations, said cutting tool having a tempered ferrous metal base with a support surface thereon and a wear surface adjacent to said support surface, an abrasive cutting element bonded to said support surface by a bonding material and projecting from said cutting tool base to form a primary cutting tip, and a hard surface coating fused onto said wear surface adjacent to said primary cutting tip, one of said bonding material and hard surface coating being comprised of a metal alloy composition having a high nickel content in the range of 45–75 weight percent of the composition and a substantial amount in the range of 5–25 weight percent of a glass-forming fluxing agent and being fused at temperatures in the range of 1830°–1925° F., and said hard surface coating having a resultant hardness in the range of 55–68 Rockwell C when fused to the wear surface of said metal base.

7. The cutting tool according to claim 6, in which said metal alloy composition also comprises 16–19 weight percent of chromium, 3–6 percent of iron, 0.5–2 percent carbon, 3–4 percent boron and 3–5 percent silicon.

8. The cutting tool according to claim 6, in which said metal alloy composition forms said hard surface coating, and said glass-forming fluxing agent is selected from a group consisting of boron compounds, silicon compounds, boro-silicates and fluoro-boro-silicates in an amount of about 2.5 to 25 weight percent sufficient to permit the fusing of said metal alloy composition in an open atmosphere furnace.

9. The cutting tool according to claim 8, in which said coating also includes up to about 34 percent by volume of an abrasive material selected from a group consisting of tungsten carbide, silicon carbide, aluminum oxide, molybdenum carbide, molybdenum boride, boron carbide, chromium carbide, vanadium carbide, zirconium carbide and titanium carbide.

10. The cutting tool according to claim 8, in which said coating also includes about 2–4 weight percent of an argillaceous material selected from a group consisting of bentonite, kaolin, montmorillonite, clay and diatomaceous earth.

11. A heavy duty cutting tool of the type subjected to large impact forces in performing such cutting functions as trenching, boring, drilling, sawing, plowing, crushing and the like as in industrial mining and like operations, said cutting tool comprising a tempered ferrous metal base provided with a support surface and a wear surface adjacent thereto, an abrasive cutting element having a base and said support surface and cutting element base having complementary surfaces for seating engagement, at least one of said complementary surfaces and wear surface being provided with a metal alloy fusing composition comprising 16–19 weight percent chromium, 3–6 percent iron, 0.5–2 percent carbon, 3–4 percent boron, 3–5 percent silicon, and 45–75 percent nickel, said composition being fused at a temperature in the range of 1830°–1925° F. and tempered to a hardness in the range of 45 to 68 Rockwell C.

12. The cutting tool of claim 11 in which the complementary surfaces are bonded together by said fusing composition.

13. The cutting tool of claim 11 in which the wear surface is coated with said fusing composition.

14. The cutting tool of claim 11 in which the complementary surfaces are bonded together and the wear surface is coated with said fusing composition.

15. The cutting tool according to claim 13, in which said abrasive cutting element has a hardness greater than said tool body and forms a primary cutting element, and said wear surface coating has a hardness lower than that of said abrasive cutting element.

16. A method for making a heavy duty, ferrous metal cutting tool having a support surface complementary to a base surface of an abrasive cutting element to be bonded to the support surface and having a wear surface adjacent to said support surface, said method comprising the steps of forming a metal alloy slurry having a composition comprised of a metal alloy powder with about 16–19 weight percent of chromium, 3–6 percent iron, 0.5–2 percent carbon, 3–4 percent boron, 3–5 percent silicon and 45–75 percent nickel, a glass-forming fluxing agent selected from a group composed of boron compounds, silicon compounds, boro-silicates and fluoro-boro-silicates and in an amount to provide 5 to 25 percent by weight of said alloy powder, and a liquid vehicle sufficient to form a flowable slurry; applying said metal alloy slurry in the form of a coating to at least one of the wear surface, support surface and base surface; drying said coating and fusing said coating to the applied surface at a preselected temperature in the range of 1830°–1925° F. to provide at least one of a hard surface coating on the wear surface and a bond between said cutting element and said support surface of said tool.

17. The method of claim 16, in which said metal alloy powder is comprised of about 70.6 percent nickel, 16.5 percent chromium and 4.5 percent iron.

18. The method of claim 16, in which said metal alloy powder is comprised of about 48.9 percent nickel, 17.4 percent chromium and 3.3 percent iron.

19. The method of claim 16, in which said coating is applied to said wear surface, and said metal alloy slurry is formed with an abrasive material comprising at least one member of the group composed of tungsten carbide, silicon carbide, aluminum oxide, molybdenum carbide, molybdenum boride, boron carbide, chromium carbide, vanadium carbide, zirconium carbide and titanium carbide.

20. The method of claim 19, in which said abrasive material is added to said slurry in an amount up to about 34 percent by volume of said metal alloy powder and is comprised of at least one member of the group consisting of tungsten carbide, silicon carbide and aluminum oxide.

21. The method of claim 16, in which said fluxing agent includes 10–15 parts of boric acid, 10–20 parts of sodium silicate and about 5 parts of a fluoride selected from a group of calcium fluoride, sodium fluoride and borium fluoride.

22. The method of claim 16, including adding a finely divided argillaceous material to the slurry in an amount to provide thickening of the slurry and to form a borosilicate glass as said coating is fused whereby fusion is permitted in an open atmosphere.

23. The method of claim 22, in which the argillaceous material is about 2 to 4 percent by weight, and is selected from a group comprising bentonite, kaolin, montmorillonite, clay and diatomaceous earth.

24. The method of claim 16, in which said coating is applied to said wear surface, and the step of adding a carbon-containing additive to the slurry to increase the carbon content of the coating composition and adjust the hardness thereof.

25. A hard surfaced heavy duty cutting tool made according to the method of claim 16.

26. The method of claim 16, in which said coating is applied to said wear surface to provide a hard surface coating thereto upon fusing, and said hard surface coating of the wear surface is fused in a carbon-containing atmosphere to increase the hardness thereof.

27. The method of claim 16, in which said coating is applied to said wear surface and the fusing is carried out in an open atmosphere induction furnace.

28. The method of claim 27, in which the wear surface coating after fusing is subjected to a high temperature carbon-containing flame to increase the hardness of the coating.

29. A hard surfaced heavy duty cutting tool made according to the method of claim 27.

30. The method of claim 16, in which said slurry coating is applied to at least one of said complementary support and base surfaces to bond the base surface of said abrasive cutting element to the support surface of said cutting tool upon fusing said coating at said preselected temperature.

31. A hard surfaced heavy duty cutting tool made according to the method of claim 30.

32. The method of claim 16, in which said slurry coating is applied to said wear surface to provide a hard surface coating thereon upon fusing, and said slurry coating is further applied to at least one of said complementary support and base surfaces to bond said abrasive cutting element to said tool support surface upon fusing.

33. A hard surfaced heavy duty cutting tool made according to the method of claim 32.

34. The method of claim 16, in which said coating is fused on the applied surface at fusion temperatures of 1830°–1925° F. in an open atmosphere induction furnace for a period of about 2 seconds to 3 minutes.

35. The method of claim 16, in which said coating is applied to said wear surface and is tempered to a hardness in the range of 45 to 68 Rockwell C.

36. A method for making a heavy duty cutting tool having a tool body formed of tempered steel at a hardness of about 43–52 Rockwell C and an abrasive cutting element formed of tungsten carbide in a base metal matrix at a hardness of about 80–90 Rockwell C, said carbide cutting element to form the primary cutting element of said tool and said tool body having a support surface to receive a complementary surface of said carbide element and a wear surface on said tool body extending away from said support surface thereof; said method comprising forming a metal alloy slurry comprising a metal alloy powder composition of about 16–19 weight percent of chromium, 3–6 percent iron, 0.5–2 percent carbon, 3–4 percent boron, 3–5 percent silicon and 45–75 percent nickel, a glass-forming fluxing agent selected from a group composed of boron compounds, boro-silicates and fluoro-boro-silicates, silicon compounds, and in an amount to provide 2.5 to 25 percent by weight of said alloy powder composition, and a liquid vehicle in an amount of about 2 to 15 percent sufficient to form a flowable slurry; applying a brazing compound to at least one of support surface and complementary surface and assemblying said carbide element on said support surface; applying said metal alloy slurry to said wear surface of said tool body to form an exterior surface coating thereon; drying said slurry coating; and heating said assembled tool body and carbide element throughout the zone of said coating to fusion temperatures in the range of about 1830°–1925° F. to braze the complementary surface of said carbide element to the support surface of said tool body and to fuse said exterior surface coating to said wear surface of said tool body to form a wear coating having a hardness greater than that of the tool body and in the range of 45–68 Rockwell C.

37. The method according to claim 36, including adding to said slurry coating up to about 34 percent by volume of an abrasive material selected from a group consisting of tungsten carbide, silicon carbide, aluminum oxide, molybdenum carbide, molybdenum boride, boron carbide, chromium carbide, vanadium carbide, zirconium carbide and titanium carbide.

38. The method according to claim 36, including adding to said slurry coating about 2 to 4 weight percent of an argillaceous material selected from a group consisting of bentonite, kaolin, montmorillonite, clay and diatomaceous earth.

39. The method according to claim 36, in which said brazing compound comprises a composition of about 16–19 weight percent chromium, 3–6 percent iron, 0.5–2 percent carbon, 3–4 percent boron, 3–5 percent silicon and 45–75 percent nickel.

40. The method according to claim 36, in which said brazing compound comprises a composition of about 81 weight percent copper, 4 percent cobalt, 14 percent manganese and 1 percent chromium.

* * * * *

UNITED STATES PATENT OFFICE

CERTIFICATE OF CORRECTION

Patent No. 4,682,987 Dated July 28, 1987

Inventor(s) William J. Brady and Harlan U. Anderson

It is certified that error appears in the above-identified patent and that said Letters Patent are hereby corrected as shown below:

Column 5, line 16, "range" should be --ranges--.

Column 10, lines 52-67, the printing on the right-hand margin is obliterated, and the last word or syllable should read:

line 52 - "fusion"
line 53 - "em-"
line 54 - "process"
line 55 - "a"
line 57 - "hard"
line 58 - "the"
line 59 - "about"
line 60 - "be"
line 61 - "hardness"
line 62 - "not"
line 63 - "duty"
line 65 - "hard-"
line 66 - "fusing"
line 67 - "carried".

Column 13, line 52, "ni" should read -- Ni --.

Signed and Sealed this

Fifth Day of January, 1988

*Attest:*

DONALD J. QUIGG

*Attesting Officer*

*Commissioner of Patents and Trademarks*

UNITED STATES PATENT OFFICE

CERTIFICATE OF CORRECTION

Patent No. 4,682,987 Dated July 28, 1987

Inventor(s) William J. Brady and Harlan U. Anderson

It is certified that error appears in the above-identified patent and that said Letters Patent are hereby corrected as shown below:

Column 13, cancel lines 15-51.

Column 17, claim 8, line 44, cancel "of about 2.5 to 25 weight percent".

Signed and Sealed this

Tenth Day of May, 1988

*Attest:*

DONALD J. QUIGG

*Attesting Officer*

*Commissioner of Patents and Trademarks*